US008002916B2

(12) United States Patent
Weitz et al.

(10) Patent No.: US 8,002,916 B2
(45) Date of Patent: Aug. 23, 2011

(54) ENERGETIC PLASTICIZER FOR EXPLOSIVE CHARGES

(75) Inventors: Amir Weitz, Kiryat Tivon (IL); Hagit Shulman, Misgav (IL); Orly Dekel, Ramat Yishai (IL); Rachel Steiner, Kiriat Yam (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 1209 days.

(21) Appl. No.: 11/573,892

(22) PCT Filed: Aug. 17, 2005

(86) PCT No.: PCT/IL2005/000898

§ 371 (c)(1), (2), (4) Date: Feb. 18, 2007

(87) PCT Pub. No.: WO2006/025047

PCT Pub. Date: Mar. 9, 2006

(65) Prior Publication Data

US 2009/0020198 A1 Jan. 22, 2009

(30) Foreign Application Priority Data

Aug. 29, 2004 (IL) ..... 163785

(51) Int. Cl.
*C06B 25/00* (2006.01)

(52) U.S. Cl. ..... 149/88

(58) Field of Classification Search ..... 149/88
See application file for complete search history.

(56) References Cited

U.S. PATENT DOCUMENTS

| | | | | |
|---|---|---|---|---|
| 4,997,499 | A | 3/1991 | Adolph | |
| 5,316,600 | A | 5/1994 | Chan et al. | |
| 6,592,692 | B2 | 7/2003 | Cho | |
| 6,620,268 | B2 | 9/2003 | Cho | |
| 2001/0030008 | A1 * | 10/2001 | Cho et al. | 149/88 |

OTHER PUBLICATIONS

Cho et al, in "An improved Mixed Formal Energetic Plasticizer" (NDIA Conference, IM-EM, Nov. 1999, Tampa, Florida, pp. 404-413.

* cited by examiner

*Primary Examiner* — Aileen Felton
(74) *Attorney, Agent, or Firm* — Mark M. Friedman

(57) ABSTRACT

An energetic material suitable for high-energy, plastic-bonded, explosive charges, the material including an energetic plasticizer containing an energetic nitrobutyl formal, wherein a composition of the energetic plasticizer contains at least 50%, by weight, of the energetic nitrobutyl formal.

29 Claims, No Drawings

ENERGETIC PLASTICIZER FOR EXPLOSIVE CHARGES

FIELD AND BACKGROUND OF THE INVENTION

The present invention relates to energetic plasticizers and, in particular, to compositions of formal-based energetic plasticizers for using in high performance, insensitive, plastic-bonded explosive (PBX) charges.

Explosives having a very high rate of reaction and high-pressure development are often useful in payloads of a wide variety of military armaments. The technical specifications for such a charge are varied, and relate to parameters including effective combat performance, maximum blast wave overpressure, blast speed and total blast energy, and safety qualities and durability under widely-varying environmental conditions.

One of the main requirements in the development of new explosive charges is to improve their safety characteristics while preserving their performance. In order to do this the warhead contains a powerful secondary explosive together with a binder and plasticizer. The identity and weight fraction of the binder and plasticizer can be changed to control the characteristics of the resulting explosive formulation.

The performance of the explosive charge is of particular importance when the charge is used in self-forging fragments (SFF), or shaped-charge (also known as hollow-charge) warheads. These warheads are used to penetrate hard targets, mainly military vehicle armor and fortifications. In such formulations the use of energetic plasticizers is of great advantage in view of the high weight fraction of plasticizers—typically 2-9% in the shaped charge.

One of the most severe limitations on storage and operation of shaped-charge warheads relates to the glass transition temperature (Tg) of the material. Below the Tg, the charge is brittle. Moving the warhead when the temperature is below the Tg can cause cracks in the explosive charge, leading to a substantial reduction in charge performance.

The glass transition is a phase transition that occurs in amorphous polymers, and is intuitively analogous to the phenomenon of melting that occurs in crystalline polymers. Below the Tg, the long-range motion of the polymer chains is stopped, and the polymer becomes hard, fragile, and breakable. Therefore, it is desirable to use a binder/plasticizer composition that has a low Tg value. However, the most common approach to the development of new energetic plasticizers is to consider the melting point of the plasticizer itself. It is well known in the art that using specific weight ratios of the energetic plasticizer components can reduce the melting temperature.

Various energetic plasticizers are known in the art. U.S. Pat. No. 4,997,499 to Adolph reports a known energetic plasticizer, a 1:1 eutectic mixture of bis(2,2-dinitropropyl) formal (BDNPF) and bis(2,2-dinitropropyl) acetal (BDNPA). However, the use of BDNPA was found to be disadvantageous, because of the limited chemical and thermal stability of BDNPA.

U.S. Pat. No. 4,997,499 to Adolph teaches an energetic plasticizer containing a 1:1 molar binary eutectic mixture of bis(2,2-dinitropropyl) formal (BDNPF) and 2,2-dinitrobutyl 2,2- dinitropropyl formal (DNBPF). It is noted that the 1:1 molar ratio of bis(2,2-dinitropropyl) formal (BDNPF) to 2,2-dinitrobutyl 2,2-dinitropropyl formal (DNBPF) produces the mixture with the lowest melting point. Although the ratio of BDNPF to DNBPF may be varied from 1:1, U.S. Pat. No. 4,997,499 to Adolph emphasizes that this results in a corresponding rise in the melting point, such that there is little, if any, advantage in doing so.

In practice, the product mixture produced in the synthesis of the eutectic mixture is composed of BDNPF, DNBPF and bis(2,2-dinitrobutyl) formal (BDNBF) in a molar ratio of 1:1:0.05, respectively. The small amount of bis(2,2-dinitrobutyl) formal present in the product does not interfere with the performance of the mixture as a thermally and chemically stable energetic plasticizer.

Cho, et al., in "An Improved Mixed Formal Energetic Plasticizer" (NDIA Conference, IM-EM, November 1999, Tampa, Fla., pp 404-413) verify that the BDNPF/DNPBF/BDNBF mixed formal disclosed by U.S. Pat. No. 4,997,499 to Adolph is characterized by good performance and superior physical properties with respect to the widely used BDNPF/BDNPA energetic plasticizer compositions.

It is emphasized by U.S. Pat. No. 6,592,692 to Cho, et al., that the synthesis taught by U.S. Pat. No. 4,997,499 to Adolph is plagued by the formation of an undesirable side product, bis(2,2-dinitropropyl) diformal. Although Cho, et al., in "An Improved Mixed Formal Energetic Plasticizer", disclose methods of reducing the amount of diformal side product produced, these methods are cumbersome and expensive, can involve additional process steps, and do not completely eliminate the formation of the diformal.

Moreover, U.S. Pat. No. 6,592,692 to Cho, et al., further notes that despite the superior thermal and chemical properties and the apparent low cost of the above-described mixed formal, no process for producing the mixed formal has been implemented in industry. U.S. Pat. No. 6,592,692 attributes this to the complexity of the process, and to the need for another precursor (2,2-dinitrobutanol) in addition to the 2,2-dinitropropanol precursor used in other processes (and hence requires an additional synthesis process).

U.S. Pat. No. 6,592,692 to Cho, et al., goes on to teach a plasticizer mixture of formals having a low melting point and containing bis(2,2-dinitropropyl) formal (BDNPF) and bis(2,2-dinitropropyl) diformal (BDNPDF).

U.S. Pat. No. 6,620,268 to Cho, et al., discloses a plasticizer mixture of formals having a eutectic mixture of BDNPF, DNBPF and BDNBF. The mixtures appear to be of a very similar composition to those obtained by U.S. Pat. No. 4,997,499 to Adolph in the laboratory and described hereinabove, i.e., BDNPF, DNBPF and BDNBF in a molar ratio of 1:1:0.05, respectively. In any event, it is explicitly taught by U.S. Pat. No. 6,620,268 to Cho, et al., that the preferable molar ratio of the BDNPF/DNPBF/BDNBF contained in the plasticizer is in the range of 20-68%/28-50%/4-30%. The plasticizer of the present invention may further contain bis(2,2-dinitropropyl) diformal by less than 5%, preferably by less than 3%, and most preferably by less than 1%.

The advantages of including BDNBF in the plasticizer are not elaborated. Indeed, it might be understood from U.S. Pat. No. 6,620,268 that BDNBF is simply a synthesis side product that, as articulated by U.S. Pat. No. 4,997,499 to Adolph, "does not interfere with the performance of the mixture as a thermally and chemically stable energetic plasticizer". The BDNBF content with respect to the total formal content is 4.3-8.9 mole % in the four examples provided in U.S. Pat. No. 6,620,268, all of which are strikingly similar to the 5 mole % obtained by U.S. Pat. No. 4,997,499 as a side product in the synthesis of BDNPF and DNBPF.

There is therefore a need for an energetic plasticizer that exhibits superior chemical and thermal stability, and is simple and inexpensive to produce.

SUMMARY OF THE INVENTION

It is an object of the present invention to provide a plastic-bonded explosive utilizing an energetic plasticizer in lieu of inert polymers or binders.

It is a further object of the present invention to utilize a single formal, e.g., BDNBF, as a plasticizer for high performance, high energy, and insensitive explosives.

It is a further an object of the present invention to provide a high energy, high performance PBX having no embrittlement problem at low temperatures (below −30° C.), using a plasticizer containing a single formal component.

According to the teachings of the present invention there is provided an energetic material suitable for high-energy, plastic-bonded, explosive charges, the material including (a) an energetic plasticizer including an energetic nitrobutyl formal, wherein a composition of the energetic plasticizer contains at least 50%, by weight, of the energetic nitrobutyl formal.

According to further features in the described preferred embodiments, the energetic plasticizer contains at least 70%, by weight, of the energetic nitrobutyl formal.

According to still further features in the described preferred embodiments, the energetic plasticizer contains at least 85%, by weight, of the energetic nitrobutyl formal.

According to still further features in the described preferred embodiments, the energetic plasticizer contains a single formal component.

According to still further features in the described preferred embodiments, the energetic plasticizer contains a pure formal component.

According to still further features in the described preferred embodiments, the energetic material further includes: (b) a binder, wherein the energetic plasticizer and the binder form a homogeneous composition.

According to still further features in the described preferred embodiments, the energetic nitrobutyl formal is bis(2,2-dinitrobutyl)formal (BDNBF).

According to still further features in the described preferred embodiments, the energetic material further includes: (c) a high explosive.

According to still further features in the described preferred embodiments, the energetic plasticizer and the binder are selected such that the homogenous composition has a glass transition temperature below minus 30° C.

According to still further features in the described preferred embodiments, the energetic plasticizer and the binder are selected such that a melting point of the energetic plasticizer is above minus 5° C., while the homogenous composition has a glass transition temperature below minus 30° C.

According to still further features in the described preferred embodiments, the energetic plasticizer and the binder are selected such that a melting point of the energetic plasticizer is above 0 C, while the homogenous composition has a glass transition temperature below minus 30° C.

According to still further features in the described preferred embodiments, the energetic plasticizer contains less than 30% of an asymmetric nitro formal.

According to still further features in the described preferred embodiments, the energetic plasticizer contains less than 20% of an asymmetric nitro formal.

According to still further features in the described preferred embodiments, the energetic plasticizer contains less than 15% of an asymmetric nitro formal.

According to still further features in the described preferred embodiments, the energetic plasticizer contains less than 10% of an asymmetric nitro formal.

According to another aspect of the present invention there is provided an energetic material suitable for high-energy, plastic-bonded, explosive charges, the material including: (a) an energetic plasticizer including an energetic nitro formal, wherein a composition of the energetic plasticizer contains at least 80%, by weight, of the energetic nitro formal.

According to still further features in the described preferred embodiments, the energetic plasticizer contains at least 85%, by weight, of the energetic nitro formal.

According to still further features in the described preferred embodiments, the energetic plasticizer contains at least 90%, by weight, of the energetic nitro formal.

According to still further features in the described preferred embodiments, the energetic plasticizer contains at least 95%, by weight, of the energetic nitro formal.

According to still further features in the described preferred embodiments, the energetic plasticizer contains less than 15% of an asymmetric nitro formal.

According to still further features in the described preferred embodiments, the energetic plasticizer contains less than 10% of an asymmetric nitro formal.

According to still further features in the described preferred embodiments, the energetic plasticizer contains less than 5% of an asymmetric nitro formal.

According to still further features in the described preferred embodiments, the energetic nitro formal is bis(2,2-dinitropropyl)formal (BDNPF).

DESCRIPTION OF THE PREFERRED EMBODIMENTS

The present invention is a formal-based energetic plasticizer for using in high performance, insensitive, plastic-bonded explosive (PBX) charges.

It is demonstrated in the present invention that in sharp contrast to what has been assumed in the art, a low glass transition temperature is achieved at a composition that is far-removed from the eutectic point of a mixture of formals and acetals, or from the eutectic point of a mixture of two or more formals.

Although formal-based energetic plasticizers of the prior art are eutectic or near-eutectic mixtures designed to have the lowest possible melting point (with respect to other compositions of the same components), the inventors have discovered that certain compositions that are far-removed from the eutectic point of a mixture of two or more formals (or from the eutectic point of a mixture of formals and acetals), and have a correspondingly-high melting point, can result in a surprisingly meaningful lowering of the glass transition temperature of a selected binder polymer, so as to achieve superior performance in PBX applications.

The energetic plasticizer is selected along with at least one inert or energetic binder so as to produce a homogenous composition of binder and plasticizer having a surprisingly low Tg. Thus, instead of the known formal mixtures, a single energetic formal having a relatively high melting temperature can be used along with an inert or energetic binder to produce a PBX with improved mechanical properties.

By way of example, the eutectic formal mixtures taught by Cho et al. have a melting point of about minus 10° C. and the eutectic formal/acetal mixture has a melting point of about minus 15° C. The inventors have discovered that a single formal, despite having a relatively-high melting point, can effectively lower the Tg of selected polymers. For example, the melting point of bis(2,2-dinitrobutyl)formal (BDNBF) was found to be well over 0° C., yet it lowered the glass transition temperature of a selected polymer below minus 50°

C. Formulated with one or more binders known to those skilled in the art, the plasticizer has no embrittlement problem at low temperatures (below −30° C.) and satisfies all performance specifications for high performance, high energy, and insensitive explosives.

Even more strikingly, the melting point of bis(2,2-dinitropropyl)formal (BDNPF) was found to be 25° C., 35° C. above the melting point of the eutectic mixture disclosed by Cho, et al., yet the corresponding glass transition temperature, when mixed with the conventional binder Viton A ® (vinylidine fluoridehexafluoropropylene co-polymer), was minus 30° C., such that the plasticizer has no embrittlement problem at low temperatures.

Thus, according to one aspect of the present invention, the energetic plasticizer contains at least 80%, by weight, of a material represented by formula A or formula B:

Formula A:

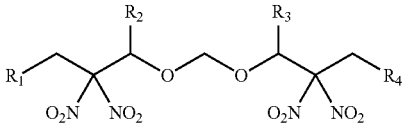

Formula B:

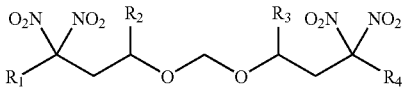

wherein:

$R_1$=$CH_3$; $R_2$=$CH_3$; $R_3$=$CH_3$, and $R_4$=$CH_3$, or $R_1$=H; $R_2$=H; $R_3$=H, and $R_4$=H, or $R_1$=$CH_3$; $R_2$=H; $R_3$=H, and $R_4$=$CH_3$, or $R_1$H; $R_2$=$CH_3$; $R_3$=$CH_3$, and $R_4$=H.

Preferably, the inventive energetic plasticizer contains at least 85%, by weight, of the material represented by formula A or formula B, and more preferably, at least 90%, by weight. In contrast to the known plasticizer compositions, this novel composition for the energetic plasticizer enables the synthesis of the plasticizer to be performed in a simple reaction procedure and using a single precursor for the reaction.

Moreover, in sharp contrast with the generally-held principle that formal-based energetic plasticizers require at least 20-68% of a propyl formal component in order to achieve a low Tg temperature, the inventors have discovered that a butyl formal, such as bis(2,2-dinitrobutyl)formal, can be used as a single formal, or as a major component, in an energetic plasticizer, and that no propyl formal component is necessary for the energetic plasticizer compositions.

Thus, in a preferred embodiment, the inventive energetic plasticizer contains at least 50%, by weight, of a butyl formal component. Preferably, the inventive energetic plasticizer contains at least 70%, by weight, of the material represented by formula A or formula B, and most preferably, at least 85%, by weight.

When the major component of the plasticizer represented by formula A or formula B is a propyl formal component, the inventive energetic plasticizer preferably contains at least 80%, by weight, of the propyl formal component. More preferably, the inventive plasticizer contains at least 85%, by weight, of the material represented by formula A or formula B, and most preferably, at least 90%, by weight. In practical syntheses, however, the upper concentration of the major formal component is often constrained by the production of side products and impurities.

The improvements inherent in the compositions taught by the present invention include: increasing of the charge efficiency by increasing the specific charge energy, improving the safety qualities of the charge, and widening the charge operational and storage envelope by reducing the charge sensitivity and reducing the glass transition temperature below minus 30° C.

As used herein in the specification and in the claims section that follows, the term "single formal component" and the like refers to a particular formal component that makes up at least 90%, by weight, of the energetic component in the plasticizer composition.

As used herein in the specification and in the claims section that follows, the term "pure formal component" refers to a particular formal component that makes up at least 95%, by weight, of the plasticizer composition.

As used herein in the specification and in the claims section that follows, the term "energetic nitro formal" refers to a formal represented by one of the following formulas:

Formula A:

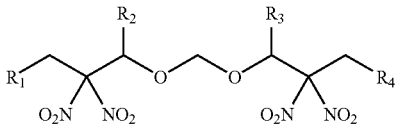

also represented by $$R_1CH_2C(NO_2)_2CHR_2OCH_2OCHR_3C(NO_2)_2CH_2R_4$$

Formula B:

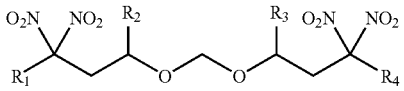

also represented by $$R_1C(NO_2)_2CH_2CHR_2OCH_2OCHR_3CH_2C(NO_2)_2R_4$$

wherein:

$R_1$=$CH_3$; $R_2$=$CH_3$; $R_3$=$CH_3$, and $R_4$=$CH_3$, or $R_1$=H; $R_2$=H; $R_3$=H, and $R_4$=H, or $R_1$=$CH_3$; $R_2$=H; $R_3$=H, and $R_4$=$CH_3$, or $R_1$H; $R_2$=$CH_3$; $R_3$=$CH_3$, and $R_4$=H.

As used herein in the specification and in the claims section that follows, the term "energetic nitrobutyl formal" refers to a formal represented by formula A or formula B, provided hereinabove, wherein:

$R_1$=$CH_3$; $R_2$=$CH_3$; $R_3$=$CH_3$, and $R_4$=$CH_3$, or $R_1$=$CH_3$; $R_2$=H; $R_3$=H, and $R_4$=$CH_3$, or $R_1$=H; $R_2$=$CH_3$; $R_3$=$CH_3$, and $R_4$=H.

As used herein in the specification and in the claims section that follows, the term "energetic nitropropyl formal" refers to a formal represented by formula A or formula B, provided hereinabove, wherein:

$R_1$=H; $R_2$=H; $R_3$=H, and $R_4$=H

As used herein in the specification and in the claims section that follows, the term "asymmetric nitro formal" refers to a formal represented by formula A or formula B, provided hereinabove, wherein $R_1$, $R_2$ and $R_3$, $R_4$ represent different moieties, i.e.:

$$R_1,R_2 \neq R_3,R_4$$

A prominent example of an asymmetric nitro formal is 2,2-dinitrobutyl 2,2-dinitropropyl formal (DNBPF).

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification, including U.S. Pat. Nos. 4,997,499 to Adolph, and 6,592,692 and 6,620,268, both to Cho, et al., are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. An energetic material suitable for high-energy, plastic-bonded, explosive charges, the material comprising:

(a) an energetic plasticizer including an energetic nitrobutyl formal, wherein a composition of said energetic plasticizer contains at least 70%, by weight, of said energetic nitrobutyl formal.

2. The energetic material of claim 1, wherein said energetic plasticizer contains at least 85%, by weight, of said energetic nitrobutyl formal.

3. The energetic material of claim 1, wherein said energetic plasticizer contains a single formal component.

4. The energetic material of claim 1, wherein said energetic plasticizer contains a pure formal component.

5. The energetic material of claim 1, the material further comprising:

(b) a binder, wherein said energetic plasticizer and said binder form a homogeneous composition.

6. The energetic material of claim 1, wherein said energetic nitrobutyl formal is bis(2,2-dinitrobutyl)formal (BDNBF).

7. The energetic material of claim 5, the material further comprising:

(c) a high explosive.

8. The energetic material of claim 5, wherein said energetic plasticizer and said binder are selected such that said homogenous composition has a glass transition temperature below minus 30° C.

9. The energetic material of claim 5, wherein said energetic plasticizer and said binder are selected such that a melting point of said energetic plasticizer is above minus 5° C., while said homogenous composition has a glass transition temperature below minus 30° C.

10. The energetic material of claim 5, wherein said energetic plasticizer and said binder are selected such that a melting point of said energetic plasticizer is above 0° C., while said homogenous composition has a glass transition temperature below minus 30° C.

11. The energetic material of claim 1, wherein said energetic nitrobutyl formal is bis(2,2-dinitrobutyl)formal (BDNBF).

12. The energetic material of claim 2, wherein said energetic nitrobutyl formal is bis(2,2-dinitrobutyl)formal (BDNBF).

13. An energetic material suitable for high-energy, plastic-bonded, explosive charges, the material comprising:

(a) an energetic plasticizer including an energetic nitro formal, wherein a composition of said energetic plasticizer contains at least 95%, by weight, of said energetic nitro formal.

14. The energetic material of claim 13, wherein said energetic plasticizer contains at least 85%, by weight, of said energetic nitro formal.

15. The energetic material of claim 13, wherein said energetic plasticizer contains at least 90%, by weight, of said energetic nitro formal.

16. The energetic material of claim 13, wherein said energetic plasticizer contains less than 15% of an asymmetric nitro formal.

17. The energetic material of claim 13, wherein said energetic plasticizer contains less than 10% of an asymmetric nitro formal.

18. The energetic material of claim 13, wherein said energetic plasticizer contains less than 5% of an asymmetric nitro formal.

19. The energetic material of claim 13, wherein said energetic nitro formal is bis(2,2-dinitropropyl)formal (BDNPF).

20. The energetic material of claim 14, wherein said energetic nitro formal is bis(2,2-dinitropropyl)formal (BDNPF).

21. The energetic material of claim 15, wherein said energetic nitro formal is bis(2,2-dinitropropyl)formal (BDNPF).

22. The energetic material of claim 13, the material further comprising:

(b) a binder, wherein said energetic plasticizer and said binder form a homogeneous composition.

23. The energetic material of claim 22, wherein said energetic plasticizer and said binder are selected such that said homogenous composition has a glass transition temperature below minus 30° C.

24. The energetic material of claim 22, wherein said energetic plasticizer and said binder are selected such that a melting point of said energetic plasticizer is above minus 5° C., while said homogenous composition has a glass transition temperature below minus 30° C.

25. The energetic material of claim 22, wherein said energetic plasticizer and said binder are selected such that a melting point of said energetic plasticizer is above 0° C., while said homogenous composition has a glass transition temperature below minus 30° C.

26. An energetic material suitable for high-energy, plastic-bonded, explosive charges, the material comprising:

(a) an energetic plasticizer including an energetic nitrobutyl formal, wherein a composition of said energetic plasticizer contains at least 50%, by weight, of said energetic nitrobutyl formal and less than 30% of an asymmetric nitro formal.

27. The energetic material of claim 26, wherein said energetic plasticizer contains less than 20% of an asymmetric nitro formal.

28. The energetic material of claim 26, wherein said energetic plasticizer contains less than 15% of an asymmetric nitro formal.

29. The energetic material of claim 26, wherein said energetic plasticizer contains less than 10% of an asymmetric nitro formal.

* * * * *